US010764672B2

(12) United States Patent
Clark et al.

(10) Patent No.: US 10,764,672 B2
(45) Date of Patent: Sep. 1, 2020

(54) OVER-EAR HEADPHONE WITH HINGE-FREE HEADBAND

(71) Applicant: MrSpeakers, LLC, San Diego, CA (US)

(72) Inventors: Daniel William Clark, San Diego, CA (US); Robert Jason Egger, San Diego, CA (US)

(73) Assignee: MrSpeakers, LLC, San Diego, CA (US)

( * ) Notice: Subject to any disclaimer, the term of this patent is extended or adjusted under 35 U.S.C. 154(b) by 0 days.

(21) Appl. No.: 16/237,223

(22) Filed: Dec. 31, 2018

(65) Prior Publication Data

US 2019/0208309 A1 Jul. 4, 2019

Related U.S. Application Data

(60) Provisional application No. 62/611,931, filed on Dec. 29, 2017.

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01)

(58) Field of Classification Search
CPC ... H04R 1/105; H04R 5/0335; H04R 2201/10
USPC ..... 381/377–378
See application file for complete search history.

(56) References Cited

U.S. PATENT DOCUMENTS

| | | | | |
|---|---|---|---|---|
| 911,178 | A * | 2/1909 | Sullivan | H04R 23/004 381/377 |
| 3,505,684 | A | 4/1970 | Hutchinson et al. | |
| 5,369,857 | A | 12/1994 | Sacherman et al. | |
| 6,434,250 | B1 | 8/2002 | Tsuhako | |
| 6,449,806 | B1 | 9/2002 | Engelhard et al. | |
| 7,072,483 | B2 | 7/2006 | Lenhard-Backhaus | |
| 7,172,052 | B2 | 2/2007 | Lenhard-Backhaus | |
| 8,325,962 | B2 | 12/2012 | Ishida et al. | |
| D736,176 | S | 8/2015 | Rapitsch | |
| 9,344,794 | B1 | 5/2016 | Blonder | |
| D777,701 | S | 1/2017 | Czaniecki | |
| 10,129,630 | B2 | 11/2018 | Kelley et al. | |

* cited by examiner

*Primary Examiner* — Suhan Ni
(74) *Attorney, Agent, or Firm* — Hall Estill Attorneys at Law; Tyler J. Mantooth

(57) ABSTRACT

An over-ear headphone system can provide optimal comfort, reliability, and fitment with a headband attached to at least one ear cup. The headband may have a first member and a second member that each extends from a rigid coupler. The rigid coupler can be configured to continuously extend about the periphery of the ear cup so that a gimbal connects the rigid coupler and the ear cup at a lateral position on the ear cup.

20 Claims, 6 Drawing Sheets

OVER-EAR HEADPHONE WITH HINGE-FREE HEADBAND

RELATED APPLICATION

This application claims the benefit of the earlier filing date of U.S. provisional patent application Ser. No. 62/611,931 filed on Dec. 29, 2017, which is incorporated herein by reference in its entirety.

SUMMARY

An over-ear headphone system, in accordance with some embodiments, has a headband attached to at least one ear cup. The headband has one or two members that each extends from a rigid coupler. The rigid coupler is configured to physically connect to the ear cup via a gimbal to allow a form fitting headband having two orders of freedom using a single physical point of ear cup rotation.

DETAILED DESCRIPTION

Various embodiments of the present disclosure are generally directed to an over-ear headphone system with optimized headband and ear cup configurations that increase user comfort, decrease weight, reduce manufacturing cost, and improve structural reliability.

Conventionally, headphones become uncomfortable when the product fits poorly on a user's head. Headphone enhancements that improve user comfort, such as adding degrees of freedom along multiple axes allow better fitment to the user's head, may increase weight and cause discomfort, but also add structural complexity that tends to decrease reliability over time. The varying sizes and shapes of users of an over-ear headphone make construction of a universal-fit headband difficult. Often, a headband is configured either for fashion or comfort without concern for long-term reliability, acoustic properties of the headphone system, or fitment. Hence, there is an industry and consumer interest in an over-ear headphone that is comfortable to wear, lighter in weight, and highly reliable while providing optimal fitment that complements the acoustic capabilities of the audio reproducing means of the headphone.

Figure 1:
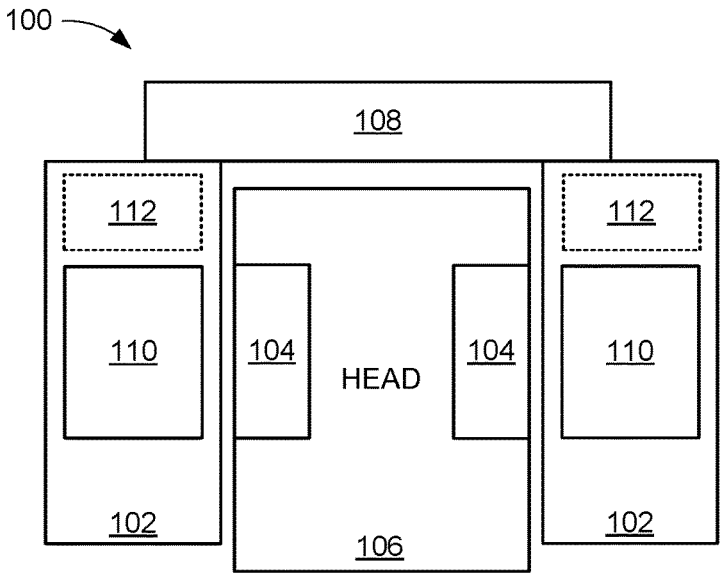
FIG. 1 is a block representation of an example headphone system in which various embodiments may be practiced.

FIG. 1 displays a block representation of an example headphone system 100 in which various embodiments may be practiced. The headphone system 100 has an ear cup 102 positioned proximal an ear 104 of the head of a user 106 with a headband 108. The ear cup 102 can house one or more audio drivers 110, such as, but not limited to, a dynamic, balanced armature, planar magnetic, or electrostatic arrangement, that converts electrical signals to sound waves experienced by the user 106.

The headphone system 100 may be configured with a single ear cup 102, but some embodiments present two ear cups 102 placed on opposite ends of the headband 108 to physically engage different ears 104 of the user 106. The headphone system 100 can have control circuitry 112 placed locally, such as in an ear cup 102, or remotely, such as an attached cable or wirelessly connected audio source.

In general, the arrangement of ear cup(s) 102 about a user 106 via a headband 108 has had little emphasis on practical acoustics of the ear cup 102 and driver(s) 110. For instance, a headphone directed to fashion are made of materials that provide an aesthetic appeal without concern for comfort during use or providing proper ear cup 102 position for different head shapes. As another example, a headphone configured primarily to provide to user comfort can result in inconsistent placement of the ear cups 102 with respect to the user 106 after the headband 108 is stretched and/or compressed during normal placement, and removal, from the user's head, or simply because the headband is so rigid it makes no allowance for diverse head shapes and/or sizes.

Figure 2A:
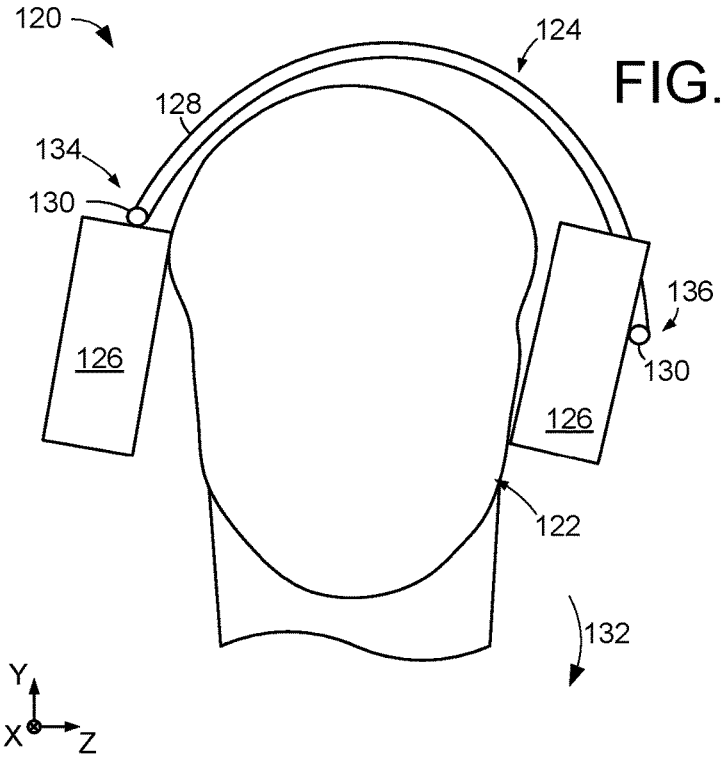
FIGS. 2A and 2B respectively display line representations of portions of an example headphone system utilized in accordance with some embodiments.
Figure 2B:
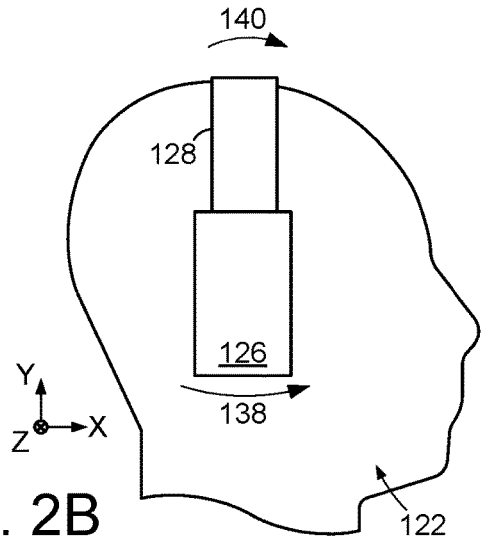

FIGS. 2A and 2B respectively convey line representations of an example headphone system 120 constructed and operated with limitations to the comfort and/or acoustic capabilities of the driver(s) 110. FIG. 2A shows a front view of a user's head 122 onto which an over-ear headphone 124 is placed. The headphone 124 is configured with ear cups 126 connected to a headband 128 via hinged connections 130 that allow for respective cup 126 rotation parallel to the Y-Z plane, as displayed by arrow 132. Such headphone 124 configuration may utilize dual hinges to provide increased rotation in the Y-Z plane about the X axis. While increasing comfort, the two-axis freedom provided by the ear cup 126 configurations add weight and complexity that result in unwanted durability and user comfort over time.

Such hinged connections 130 can accommodate variations in the user's head 122 shape and/or size, but impacts how the tension of the headband 128 applies pressure on the ear cups 126. Regardless of whether the hinged connection 130 is positioned at a top position, as indicated by arrow 134, or positioned at a medial positioned, as indicated by arrow 136, the tension of the headband 128 is likely to place uneven pressure on the ear cup 126, which results in discomfort and a non-uniform cup coverage about the user's ear 104, as illustrated.

The side view of FIG. 2B conveys how the headband 128 can result in unwanted ear cup 126 rotation parallel to the X-Y plane, as indicated by arrow 138. While the headband 128 may apply tension and/or compression in the Y-Z plane, rigidity of the headband 128 in the X-Y plane results in the ear cup 126 rotation that positions the driver(s) 110 housed in the cups 126 in non-optimal locations relative to the user's ear 104. The resistance of the headband 128 to twisting, as indicated by arrow 140 parallel to the X-Y plane, further decreases user comfort by being susceptible to user movement, such as jumping, running, and sudden head movements.

It can be appreciated that the implementation of a rotational system, such as ball joints, elastic suspensions, and/or hinges, to connect the ear cups 126 to the headband 128 provides two axes of rotation that must be accommodated using a combination of hinges, bushings, bearings, and/or other structures that add bulk and complexity and are vulnerable to reliability and fitment degradation over time. In addition, greater number of headphone parts add cost and weight to the headphone. With these issues in mind, embodiments are generally directed to an over-ear headphone system that optimizes the headband itself and the manner in which the headband attaches to the ear cup(s) to provide near-universal fitment that maximizes the potential of the design of the ear cup and constituent audio driver(s). It is noted that the ear cups 126 can be any size, shape, open back, or closed back.

Figure 3A:
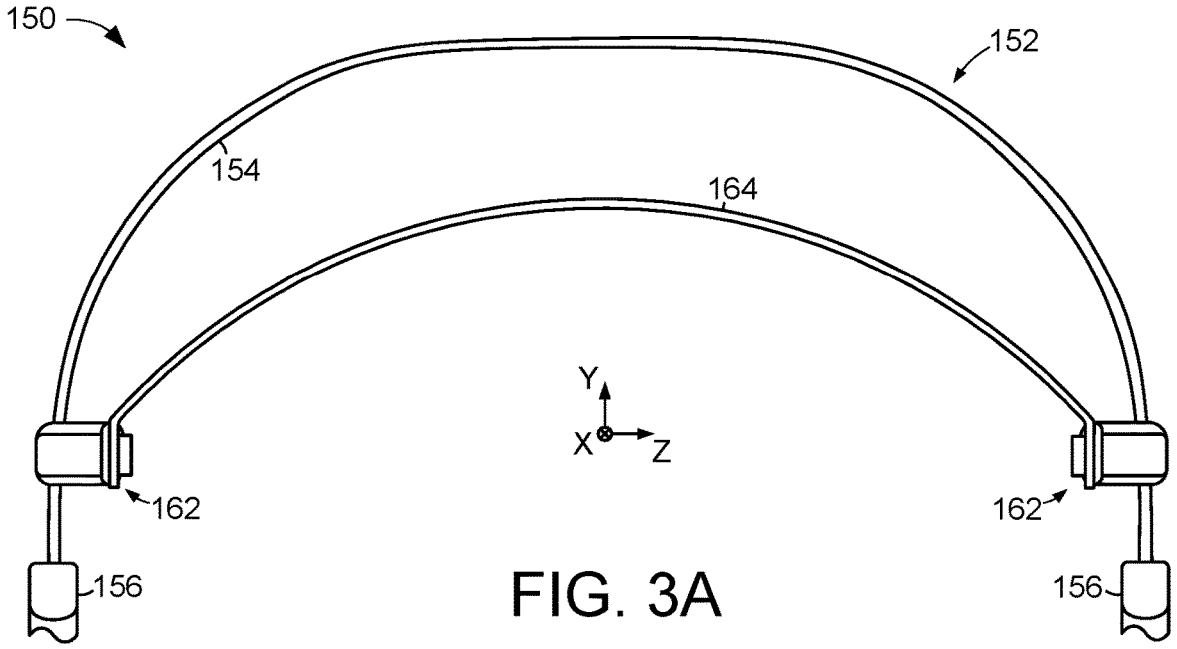
FIGS. 3A and 3B respectively show portions of an example over-ear headphone system configured in accordance with assorted embodiments.
Figure 3B:
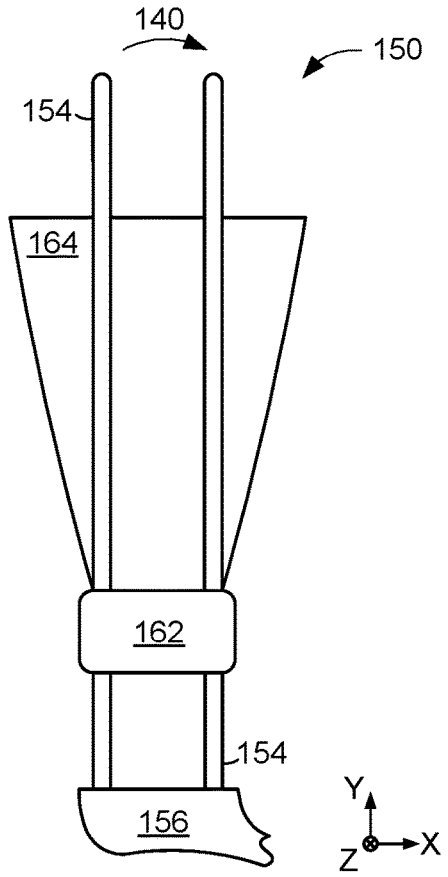

FIGS. 3A and 3B respectively illustrate portions of an example over-ear headphone 150 arranged in accordance with assorted embodiments. The headphone 150 has a headband 152 constructed of one or more members 154 each extending out of, and between, rigid couplers 156. The rigid couplers 156 may be constructed of any rigid, semi-rigid, or flexible material, such as metal, plastic, or ceramic, that can retain a shape without flexing in response from compression applied by the headband 152. A rigid coupler 156 can have any shape and size conducive to supporting the headband member 154 without flexing. Each headband member 154 can be physically attached to the respective couplers 156 via a fixed connection or a rotating connection, without limitation.

That is, the members 154 can be configured to rotate within the couplers 156 or have a set orientation with respect to the couplers 156, while be retained within the couplers 156 during movement of the couplers 156, such as the rotation 158 of a coupler 156 shown in FIG. 3B as arrow 160. Thus, the headband members 154 can move, or flex, relative to one another while remaining attached to the couplers 156 to generate required headband twist (140) and movement required to ensure listener comfort without displacing the ear cups attached to the rigid couplers 156.

As shown, the headband members 154 can be constructed with matching shapes and sizes, which may correspond with matching material constructions. However, some embodiments configure the members 154 to be dissimilar in shape, size, and/or material so that the headband 152 collectively delivers different tension, compression, and/or rotation properties along one or more axes, such as towards one ear or the user's face compared to the other ear or posterior portion of the user's head.

Although not required or limiting, one or more headband members 154 can be constructed of materials, such as Nickel Titanium, spring steel, and flexible composites, that return to a set shape and set amount of applied force onto a user's head despite being flexible. The materials may have a uniform, or varying cross-sectional shape, such as round, rectangular, or multifaceted. In this way, the headband members 154 can flex to provide vertical (Y axis) and horizontal (X axis) rotation that provides the same pressure vectors and volumes onto the user's head regardless of the shape of the respective members 154. As a result, the simple spanning of rigid couplers 156 with one or more headphone members 154 provides a comfortable fit without the weight, bulk, cost, and reliability issues of headbands designed specifically for fashion or comfort.

In some embodiments, the headphone members 154 can pass through a fixed, or sliding, spacer 162 that physically connects the respective members 154 while allowing the members 154 to flex, move, vibrate, compress, and apply force while the spacer 162 may, or may not, serve to locate a suspended comfort member 164, such as a strap of synthetic or natural material that rests on the user's head and supports the weight of the headphone. The tensioner(s) 154 can be in sliding, fixed, or stepped engagement with the headphone members 154 to allow for user adjustment of the headphone fit, without interfering with the rotational behavior of the headphone members 154. Headphone fitment, in some embodiments, is facilitated without spacers 162 and the headphone members 154 are configured to physically contact the user's head, which may include a flexible material wrapped around one or more members 154 to increase comfort.

It is contemplated that a comfort member 164 can span between the spacers 162. Such as comfort member 164 may be flexible, or rigid, and configured to contact a user's head to secure the headband 162 relative to the user's ears 104. The comfort member 164 may move independently of the headband members 154, which allows the members 154 to rotate and move to accommodate user movement while applying consistent pressure onto the rigid couplers 156. For instance, the comfort member 164 may be a strap of compliant material, such as leather, synthetic leather, fabric, mesh, or other pliable textile.

Figure 4A:
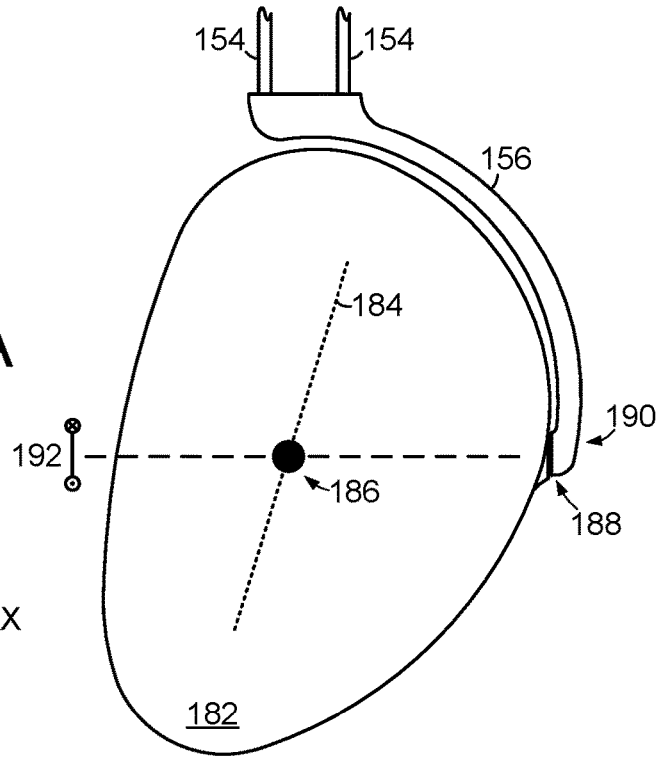
FIGS. 4A and 4B respectively illustrate portions of an example over-ear headphone system arranged in accordance with various embodiments.
Figure 4B:
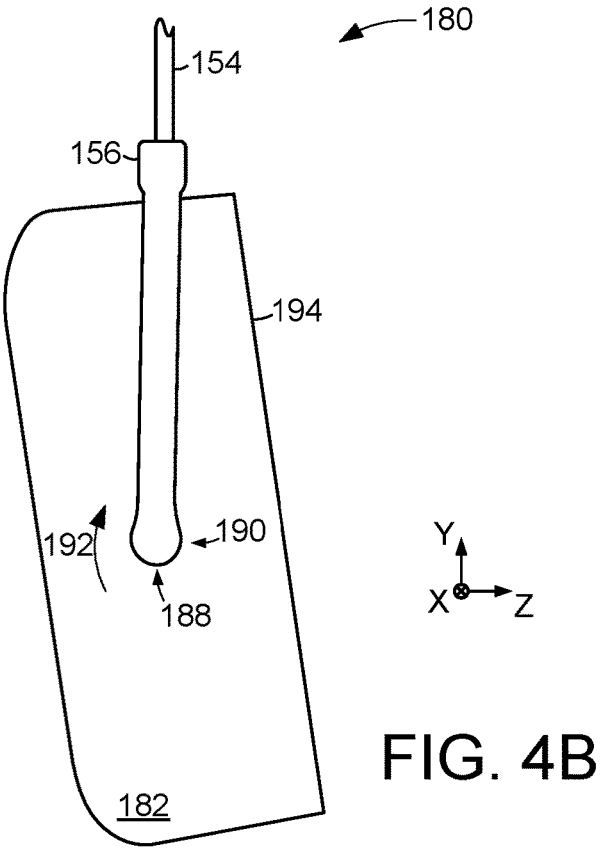

FIGS. 4A and 4B respectively display portions of an example ergonomic over-ear headphone 180 that can be incorporated into the headphone system 100 of FIG. 1 in conjunction with the aspects of FIGS. 3A and 3B. In the side view of FIG. 4A, an ear cup 182 has an asymmetrical shape in the X-Y plane that is conducive to comfortably covering the ear of user and providing an acoustic seal for one or more audio drivers housed within the ear cup 182. The ear cup 182 has a longitudinal axis 184 that may be non-parallel with a vertical plane corresponding with the Y axis. However, the cup shape and size configurations of FIG. 4A are not limiting or required and other configurations can be utilized, such as circular or other shapes that cover some, or all, of a user's ear.

The ear cup 182 has a centerpoint 186 that may correspond with a center of pressure for the ear cup 182 alone, or in combination with the attached rigid coupler 156. While not limiting or required, the ear cup 182 is connected to the rigid coupler 156 via a gimbal 188 that allows single axis rotation of the ear cup 182, parallel to the vertical Y axis, relative to the rigid coupler 156. The gimbal 188 is positioned in alignment with the centerpoint 186 and the horizontal X axis by an arm of the rigid coupler 156. That is, the rigid coupler 156 continuously extends from a top position between the headband 152 and ear cup 182 to a lateral position 190 in-line with the ear cup centerpoint 186. It is noted that while the gimbal 188 is shown with one point of attachment to the ear cup 182, a two-point connection may be utilized without affecting the fitment or function of the headphone 180.

The alignment of the gimbal 188 with the ear cup centerpoint 186 provides efficient and comfortable application of force to the ear cup 182. Rotation of the ear cup 182 around the gimbal 188 connection applies continuous pressure on the ear cup 182 to hold the ear cup 182 in a default position, as shown, while allowing vertical rotation around the X axis, as indicated by arrow 192. While not required, the gimbal 188 can be configured with one or more limit-stops, bushings, springs, and/or bearings positioned within the coupler 156 and/or ear cup 182 to restrict ear cup tilting in the X-Y plane or rotation about the Y axis.

In contrast, a conventional hinged connection would prevent rotation of the ear cup 182 while a ball-joint connection would degrade the application of force from the coupler 156 to the ear cup 182 and increase the width of the headphone 180 in a direction parallel to the Z axis, which would result in user discomfort and/or poor orientation of the ear cup 182 to the coupler 156. Hence, the gimbal 188 can allow for vertical ear cup rotation 192 independent of the coupler 156 that adapts the ear cup's orientation relative to the user's head about the X axis while the headband members 154 provide gentle, consistent twisting force about the Z axis that maintains the ear cup 182 in a desired, comfortable position despite user movement.

FIG. 4B illustrates how the gimbal 188 allows ear cup rotation 190 about the X axis while applying force from the coupler 156 throughout the acoustic surface 194 of the ear cup 182. That is, the gimbal 188 configuration and alignment with the cup centerpoint 186 prevents ear cup movement and rotation, except vertical rotation 192, so that force from the headband members 154 is distributed across the surface area of ear pad acoustic surface 194, which results in a comfortable and effective acoustic seal with the user's head proximal the ear.

Figure 5A:
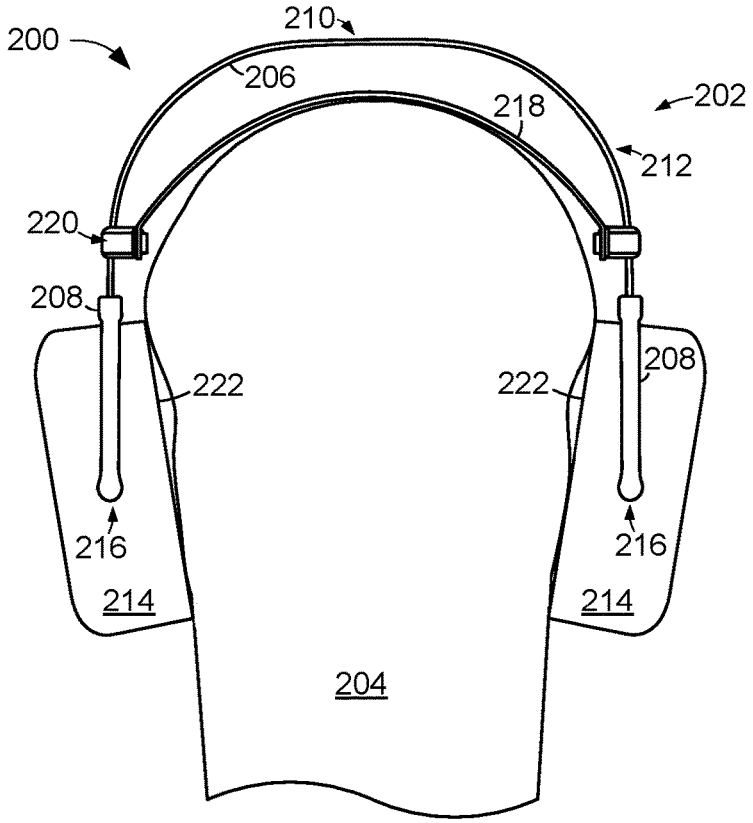
FIGS. 5A and 5B respectively depicts portions of an example over-ear headphone system operated in accordance with some embodiments.
Figure 5A:
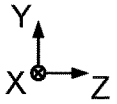
Figure 5B:
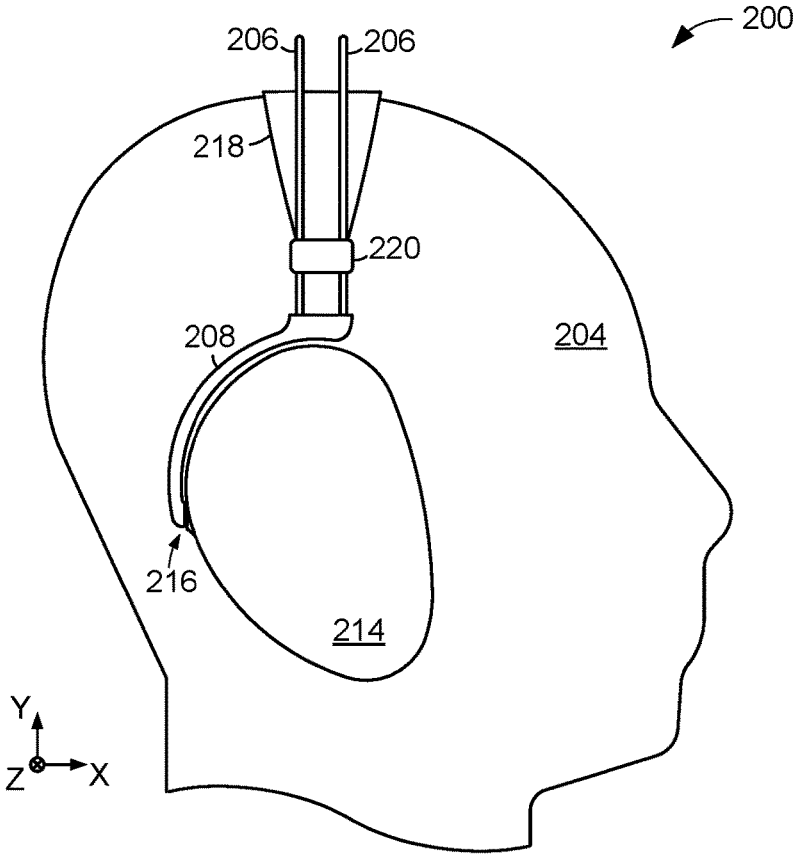

FIGS. 5A and 5B respectively display an example over-ear headphone system 200 that employs the various embodiments of FIGS. 3A-4B to provide optimal fitment, comfort, and acoustic reproduction. FIG. 5A is a front view of how an over-ear headphone 202 can interact with a user's head 204. One or more headband members 206 are each single-piece wires with a circular, oblong, rectangular, multifaceted, or other cross-sectional shape that extend between rigid couplers 208. The headband members 206 each have a linear portion 210 that has an appropriate length positioned between curvilinear portions 212. It is noted that the linear portion 210 is not required. Such headband shape, along with the material construction of the members 206, apply a predetermined amount of force onto the rigid couplers 208 that is then translated to respective ear cups 214 via gimbal 216 connections.

Although not required, a comfort feature 218 extends between spacers 220 that are attached to at least one headband member 206. The spacers 220 may restrict headband member 206 movement relative to one another, but such configuration is not required as a spacer 220 may also be used as a slider to not only control the member 206 spacing and rotation, but also to serve as a support for the comfort feature 218. In other words, spacers 220 may be used to maintain a fixed distance between separate headband members 206, such as 3 cm or less, or serve as fixed, or sliding, mounting posts for the comfort features 218.

A spacer 220 can apply pressure onto one, or both, headband members 206, such as with a spring, clamp, weight, or elastic material, to provide resistance to member 206 movement, collectively and individually, without preventing movement and/or rotation of the headband. The spacer 220 may be permanently affixed to the headband members 206, in some embodiments, may slide, or incrementally step, along the members 206, may be removable, or may be absent in other embodiments. The configuration of the headband members 206 and rigid coupler 208 provides consistent pressure onto the gimbal 216 and respective ear cups 214 that forces the acoustic surface 222 into contact with the user's head 204 proximal the user's ear. It is noted that the ear cups 212 can be arranged to completely surround a user's ear, partially surround a user's ear, and/or contact the ear itself to create an acoustic environment conducive to optimal audio driver operation.

As shown in the side view of FIG. 5B, the gimbal 214 connection with the ear cup 214 allows the acoustic surface 222 to rotate relative to the rigid coupler 208 to equalize pressure on the user's head from the acoustic surface 222 shown in FIG. 5A. That is, any pressure imbalance imparted from the headband members 206 onto the rigid coupler 208 is equalized with rotation of the ear cup 214 via the gimbal 216. It is contemplated that the pressure and force imparted on the ear cup 214 from the rigid coupler 208 is controlled via rotation control feature of the gimbal 216, which may comprise one or more bushings, bearings, and seals to restrict and/or limit ear cup 214 movement and rotation so that force is uniformly applied onto the user's head throughout the acoustic surface 222.

The gimbal 216 may move freely or incorporate one or more rigid stops that interact with the rigid coupler 208 to limit ear cup some movement in the Y-Z and X-Y planes. Adjustment and/or removal of the gimbal 216 can be facilitated, in some embodiments, with a bushing or bearing in combination with a pressure-releasing screw that allows the ear cup 214 to be tightened, loosened, or removed from the rigid coupler 208 without full disassembly of the ear cup 214. The flexibility of the headband members 206 can allow the ear cups 214 to be easily manipulated for storage into containers of various sizes and shapes. However, some headband and/or ear cup 214 manipulation can place unwanted stress on the gimbal 216. In some instances, such as during travel, having the physically smallest headphone may be beneficial. Hence, various embodiments arrange the gimbal 216 to be foldable to alleviate stress during headphone 202 storage.

Figure 6:
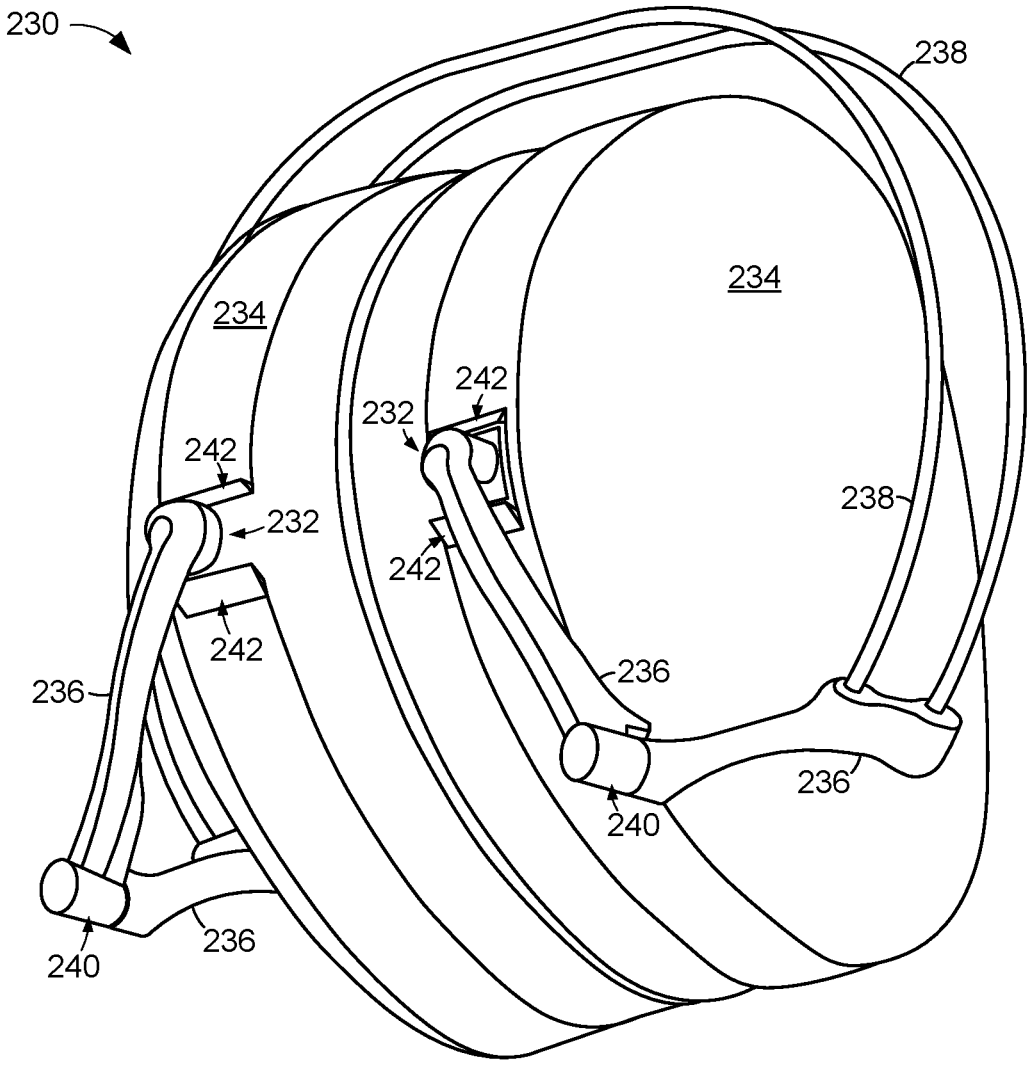
FIG. 6 conveys an example over-ear headphone configured in accordance with assorted embodiments.

FIG. 6 conveys an example over-ear headphone 230 with the embodiments of FIGS. 3A-5B that employs a gimbal 232 that can be folded to reliably store the ear cups 234 between the rigid couplers 236 and headphone members 238. By rotating the respective rigid couplers 236 about a pivot 240, the ear cups 234 retract while facing one another. The pivot 240 can be any rotating mechanism and, in some embodiments, locks to prevent unintentional ear cup 234 movement.

The retracted position of the ear cups 234, as shown, utilizes the compression force applied by the headband members 238 to maintain the retracted position during headphone 230 movement, such as during travel. It is contemplated, but not required, that the pivot 240 is spring-loaded to aid the physical transition of the ear cups 234 from the retracted position shown in FIG. 6 to the usable position shown in FIGS. 5A and 5B. Unlike previous headphones that employ collapsing, or otherwise hinging, headbands, the gimbal 236 connects to the headband members 238 with the pivot 240 in the middle of the gimbal 236, which allows for the very compact folding geometry.

Figure 7:
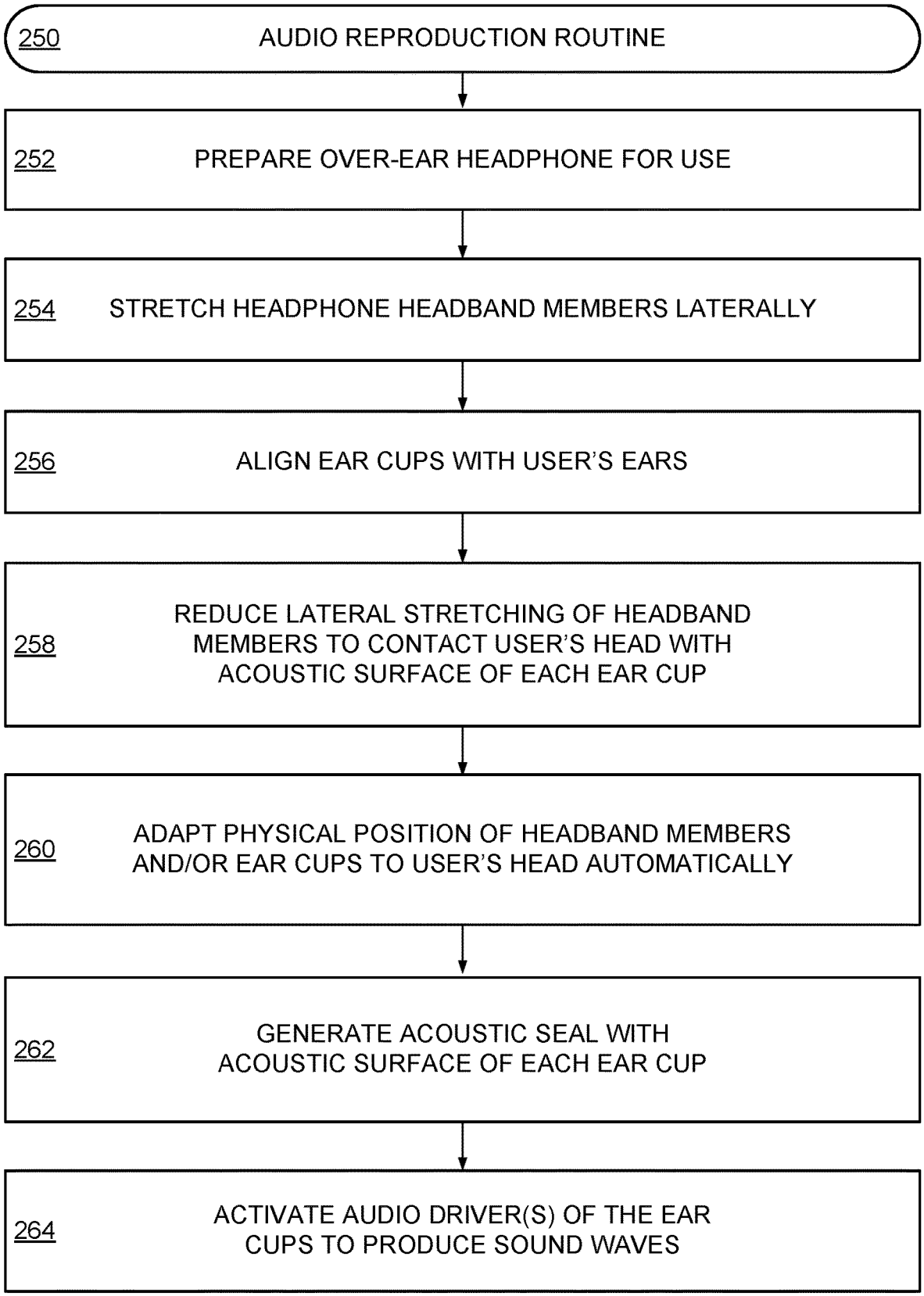
FIG. 7 provides a flowchart of an example headphone utilization routine that can be carried out by the over-ear headphone systems of FIGS. 1-6.

FIG. 7 is a flowchart of an example audio reproduction routine 250 that can be carried out with an over-ear headphone arranged in accordance with the various embodiments of FIGS. 3A-6. Step 252 begins by preparing an over-ear headphone for use, which may entail removing the headphone from a storage container or package by unfolding one or more gimbal connections. It is contemplated that step 252 may involve assembling and/or adjusting portions of the over-ear headphone, such as the gimbal connection and/or headband member tensioner.

Preparation of the over-ear headphone advances routine 250 to step 254 where the headband members are laterally stretched, along the Z axis, to widen the separation distance between ear cups. The configuration of the headband members will allow such lateral stretching while applying increasing amounts of physical resistance as the ear cup separation grows. It is noted that step 254 can involve rotating the headband members with respect to one another, and around the Z axis, to position the ear cups in a desired orientation with respect to the user's head and ears.

It is noted that the headband members are configured with a default shape, position, and size where minimal, or zero, pressure will be applied on the ear cups. In yet, the headband members are constructed to allow flexibility to adapt to a user's manipulation while providing feedback in the form of physical resistance. The lateral stretching of the headband members in step 254 allows the ear cups to be moved into alignment with the user's ears in step 256 while the ear cups have a separation distance that is greater than the distance between the user's ears.

Next, step 258 reduces lateral stretching of the headband members, which allows the tension of the members to bring the ear cups into physical contact with the user's head. Once the user has removed external force from the ear cups, step 260 adapts the position of the ear cups and/or headband members to generate an acoustic seal between the ear cup and head in step 262. In step 260, the flexible configuration of the headband members can manually or automatically adapt to the shape of a user's head by rotating and/or moving relative to one another. The gimbal connection of the ear cup and rigid coupler can also automatically adapt to the shape of a user's head by vertically rotating the ear cup relative to the rigid coupler.

With the adaptation of the headphone members and/or ear cups in step 260 without manipulation from the user, the acoustic surface of the respective ear cups can uniformly contact the user's head with force equalized via the gimbal connection. In other words, the force applied to the rigid coupler from the headband members in step 260 can be different than the pressure applied to the ear cups and acoustic surfaces due to the gimbal connection. Such pressure translation through the gimbal results in a uniform amount of force applied along the Z axis from the acoustic surface of each ear cup to form an optimized acoustic seal that is utilized in step 264 when the audio driver(s) of the respective ear cups are activated via electrical signal to produce sound waves.

It is noted that the various steps of routine 250 are not required or limiting and changes can be made without deterring from the spirit of the present disclosure. For instance, steps can be changed or removed just as decisions and/or steps can be newly added.

Through the assorted embodiments of an over-ear headphone, multiple separate headband members allow for vertical and horizontal rotation of a headband that provides comfort while automatically adapting to the shape of a user's head. The use of a rigid coupler and gimbal to translate the force applied by the headband members to the ear cups results in consistent, controlled pressure onto an acoustic surface that produces a uniform acoustic seal throughout the acoustic surface of each ear cup. The configuration of the rigid coupler and gimbal further provide adjustment that can enhance the generation of the acoustic seal without adding weight, bulk, cost, or reliability risk to the headphone.

What is claimed is:

1. An apparatus comprising a headband attached to an ear cup as part of a headphone, the headband comprising first and second members each extending from a rigid coupler, the rigid coupler connected to the ear cup via a gimbal, the ear cup having a centerpoint in an X-Y plane located at a center of pressure for the ear cup, the gimbal separated from the X-Y plane and from the centerpoint along a Z axis, the gimbal aligned with the centerpoint to rotate the ear cup around an X axis extending through the centerpoint.

2. The apparatus of claim 1, wherein at least one of the first and second members comprises a Nickel Titanium material configured to apply spring-force on the ear cup towards a head of user.

3. The apparatus of claim 1, wherein the first member has a dissimilar shape than the second member.

4. The apparatus of claim 1, wherein the rigid coupler comprises a first piece connected to a second piece via a hinging pivot.

5. The apparatus of claim 1, wherein the gimbal is aligned with the centerpoint of the ear cup along an Y axis.

6. The apparatus of claim 1, wherein the ear cup has an asymmetrical shape in the X-Y plane.

7. The apparatus of claim 1, wherein the rigid coupler combines the first and second members into a single connection into the ear cup at the gimbal.

8. The apparatus of claim 1, wherein the rigid coupler continuously extends from a vertical position relative to the ear cup in the X-Y plane to a lateral position relative to the ear cup, the lateral position located between an acoustic surface of the ear cup and an exterior surface of the ear cup, the exterior surface located in the X-Y plane.

9. The apparatus of claim 8, wherein the lateral position is aligned with the centerpoint of the ear cup to rotate the ear cup around the X axis extending through the centerpoint.

10. The apparatus of claim 8, wherein the vertical position is aligned with the centerpoint of the ear cup via a longitudinal axis of the ear cup in the X-Y plane.

11. A headphone comprising a headband continuously extending between a first ear cup and a second ear cup, the headband comprising first and second members each extending between a first rigid coupler and a second rigid coupler, each rigid coupler connected to the ear cup via a gimbal, each gimbal positioned to rotate the respective ear cups around an X axis extending through a centerpoint of the respective ear cups, each centerpoint separated from the respective gimbals along the X axis and located at a center of pressure for an acoustic surface of the respective ear cups, the acoustic surface of each ear cup extending in an X-Y plane to contact a head of a user.

12. The headphone of claim 11, wherein a first spacer and second spacer each slidingly connect the first member and the second member, the first spacer physically separate from the second spacer.

13. The headphone of claim 12, wherein a comfort feature continuously extends between the first and second spacers.

14. The headphone of claim 11, wherein each spacer is physically separated from each rigid coupler.

15. The headphone of claim 11, wherein each rigid coupler has a pivot allowing a first coupler section to rotate relative to a second coupler section.

16. A method comprising:

positioning an ear cup proximal to a head of a user, the ear cup connected to a headband, the headband comprising first and second members each extending from a rigid coupler, the rigid coupler connected to the ear cup via a gimbal;

articulating the headband to apply spring force onto the head of the user; and rotating the ear cup relative to the head of the user via the gimbal to surround an ear of the user with the ear cup, the ear cup rotating around an X axis extending through a centerpoint of the ear cup, the centerpoint separated from the gimbal along the X axis and located at a center of pressure for an acoustic surface of the ear cup, the acoustic surface of the ear cup extending in an X-Y plane to contact the user.

17. The method of claim 16, wherein the ear cup rotates relative to the head of the user automatically in response to the spring force from the headband.

18. The method of claim 16, further comprising moving a spacer to alter the spring force of the headband, the spacer connecting the first member to the second member.

19. The method of claim 16, wherein the rotation of the ear cup generates an acoustic seal with the head of the user via the acoustic surface of the ear cup.

20. The method of claim 16, wherein the ear cup remains surrounding the ear of the user while the headband is twisted.

* * * * *